United States Patent [19]

Campbell, Jr.

[11] 4,444,348

[45] Apr. 24, 1984

[54] COMPENSATING NAIL CHUCK

[75] Inventor: Alexander M. Campbell, Jr., Fredricksburg, Va.

[73] Assignee: Campbell Atlantic, Inc., Ladysmith, Va.

[21] Appl. No.: 350,855

[22] Filed: Feb. 22, 1982

[51] Int. Cl.[3] ..... B25C 7/00

[52] U.S. Cl. ..... 227/149; 227/139; 227/140; 227/147

[58] Field of Search ..... 173/139; 227/149, 147, 227/140, 141

[56] References Cited

U.S. PATENT DOCUMENTS

| | | | |
|---|---|---|---|
| 853,931 | 5/1907 | Milliken | 227/149 |
| 1,605,053 | 11/1926 | Morgan | 227/149 |
| 1,755,225 | 4/1930 | Paxton | 227/149 |
| 2,184,745 | 12/1939 | Kinneman | 61/77 |
| 2,534,140 | 12/1950 | Moore | 141/32 |
| 2,557,757 | 6/1951 | Paxton et al. | 1/5 |
| 2,890,455 | 6/1959 | Etzkorn | 173/139 |
| 3,489,229 | 1/1970 | Uebel et al. | 173/131 |
| 3,991,833 | 11/1976 | Ruppert | 173/20 |

OTHER PUBLICATIONS

Catalog by SPEC Associated Spring Barnes Group, Inc.; "Belleville Spring Washers"; pp. 8–11.

*Primary Examiner*—E. R. Kazenske
*Assistant Examiner*—Willma Fridie, Jr.
*Attorney, Agent, or Firm*—Griffin, Branigan & Butler

[57] ABSTRACT

A compensating nail chuck includes a driving rod (12) having a yieldable force-transmitting member (34) comprised of a belleville-washer spring system which compresses in size in response to a back force on the driving rod created by driving a nail. A main housing (10) of the chuck has freedom of vertical movement on a chuck bar (26) for a distance equal to a tolerance difference to be compensated for.

8 Claims, 3 Drawing Figures

COMPENSATING NAIL CHUCK

BACKGROUND OF THE INVENTION

This invention relates to the art of nailing machines.

Nailing machines normally comprise a main housing having a bore for holding a nail and a driving rod, slidable in the bore, for impinging on the head of the nail and driving it from the lower end of the bore into a board. In general operation, after a nail has been driven, a chuck bar on which the housing is mounted lifts the housing from the board while a driving head attached to the driving rod lifts the driving rod even further, so that it is partially pulled out of the bore of the housing. Once both the housing and the driving rod are in this lifted position, a new nail is fed into the bore from the side, and both the housing (under control of the chuck bar) and the head are moved downwardly until the housing is in contact with a board into which the new nail is to be driven. The driving head continues downwardly, urging the driving rod against the head of the new nail to drive the new nail from the housing into the board. The extent of movement of both the chuck bar and the driving head are preset in accordance with the thickness of the board into which nails are being driven. That is, the driving head moves downwardly in a driving stroke until it reaches a predetermined point, at which time both it and the housing move upwardly.

A problem with such prior-art nailing chucks is that it is often desirable to use them in making "rough" goods such as pallets from "rough-cut" lumber. The tolerances of such lumber are such that thickness dimensions vary upwardly to as much as three-eighths of an inch for pallets, for example. Most prior-art nailing chucks will not compensate for this $\frac{3}{8}''$ thickness differential and they must therefore be set to nail the thickest possible boards. This means that when the nailing chucks are used to nail thinner boards, the heads of the nails are left above the boards and must often be driven home by hand. Thus, when a battery of nailing chucks is usd to nail a pallet, for example, it is often necessary after each cycle for a workman to pound in nails that were not completely driven by the machine. It is therefore an object of this invention to provide a nailing chuck which compensates for uneven thicknesses of boards to drive all heads of nails into the boards, within a rather large range of board thicknesses.

An attempt was made to make a compensating nailing machine in 1926 by H. W. Morgan, as is disclosed in U.S. Pat. No. 1,605,053. However, the device disclosed by Morgan does not appear to be practical because it will probably not withstand the rigors of long operation as is required of nailing machines. In this respect, on every cycle of the Morgan machine, a shoulder 19 impinges heavily on a casting 10, thereby causing an undue pounding of both these members. Further, the operation of this machine relies on compression springs 21 and 28 which will not properly function over a large number of cycles. It is therefore an object of this invention to provide a compensating nailing chuck which is not unduly stressed on each cycle and which can continue to function accurately over a large number of cycles.

It is another object of this invention to provide a compensating nailing chuck which is relatively easy and inexpensive to manufacture.

SUMMARY

According to principles of this invention, a force-transmitting member of a nail-chuck driving rod compresses in response to a back force created by driving a nail. Thus, the driving rod drives a nail by balancing forces of the force-transmitting member and the nail. In the preferred embodiment, belleville washers are employed as the compressible force-transmitting member.

Also in accordance with principles of the invention, the housing of a chuck is mounted on a chuck bar with freedom of movement for a distance equal to a distance to be compensated for.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention a clear manner.

DESCRIPTION OF THE PREFERRED EMBODIMENT

Figure 1:
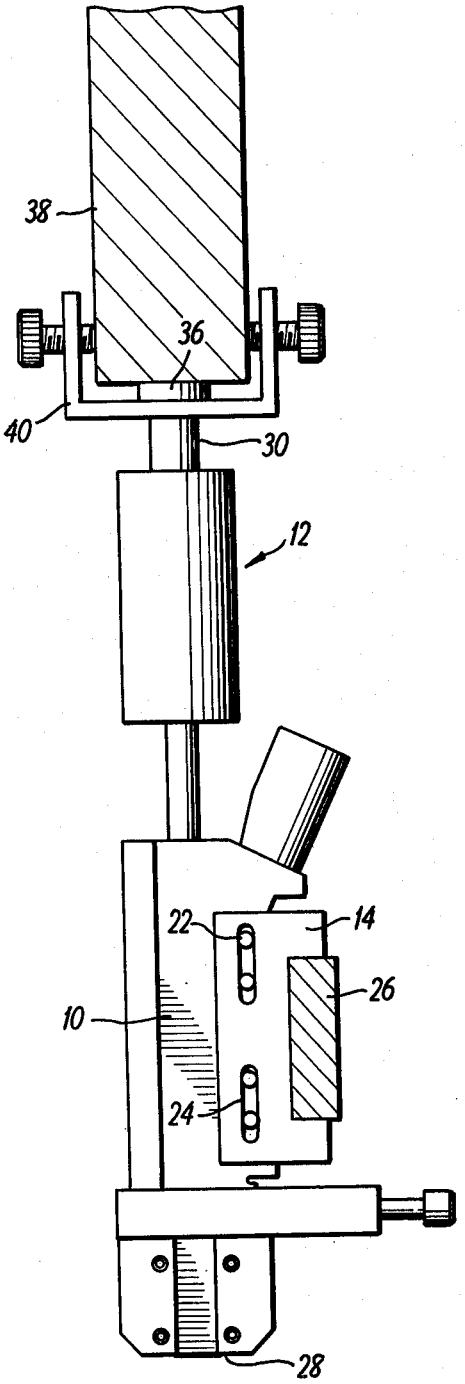
FIG. 1 is a side view of a compensating nail chuck in accordance with principles of this invention.

Referring to FIG. 1, a compensating nail chuck of this invention includes a main housing 10, a driving rod 12 and a chuck-bar mount 14.

Figure 2:
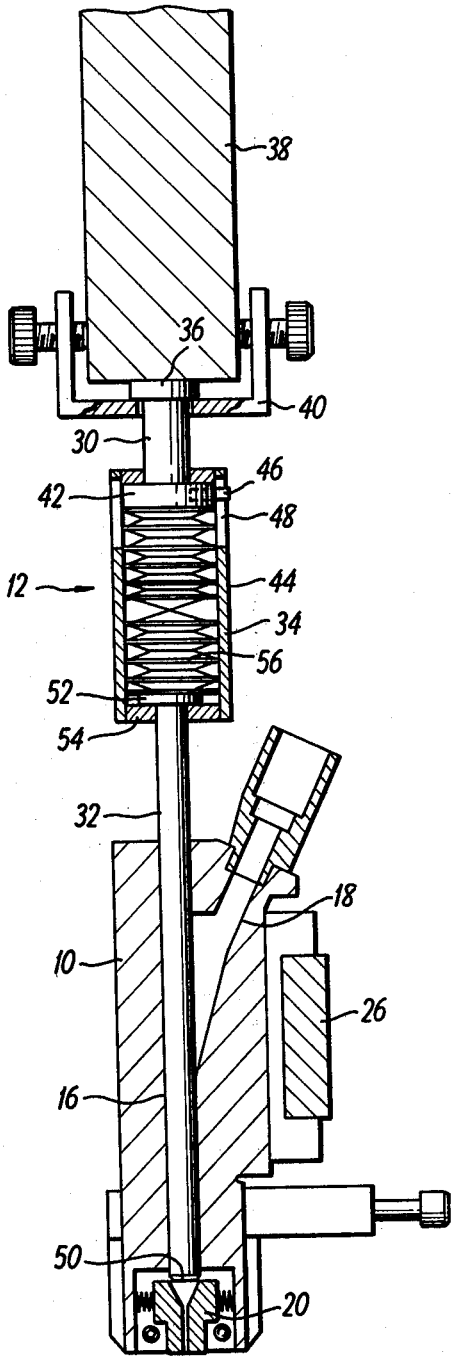
FIG. 2 is a side sectional view of the compensating nail chuck of FIG. 1 and also including, in section, a driving head to which the compensating nail chuck is coupled.

With reference to FIG. 2, the main housing 10 defines a nail-receiving bore 16 which communicates with a nail feed channel 18. Pivotally mounted lip members 20 form a mouth for the bore 6 which opens to allow a nail to be driven therefrom in the manner of some prior-art nail chucks.

The chuck-bar mount 14 is coupled to the main housing 10 by means of pins 22 fixedly attached to the housing 10 and slots 24 formed in the chuck-bar mount 14. This arrangement provides freedom of vertical movement of the main housing 10 relative to a chuck bar 26 to which the chuck-bar mount 14 is attached. The amount of this freedom of vertical movement in the preferred embodiment is approximately $\frac{3}{8}''$, which is the same distance that the compensating nail chuck of this invention can compensate for board thicknesses. Downward movement of the main housing 10, to the extent of slots 24, is caused by gravity, while upward movement thereof is caused by a board impinging on a lower end 28 of the main housing.

The driving rod 12 includes a top rod 30, a lower rod 32, and a yieldable force-transmitting member 34. The top rod 30 has a head 36 at the upper end thereof for fastening the top rod 30 to a driving head 38 by means of a clamp 40. The lower end of the top rod 30 comprises a piston 42 which rides in a cylinder 44 of the yieldable force-transmitting member 34. In this respect, the piston 42 has pins 46 attached thereto which extend through slots 48 in the cylinder 44 to limit movement of the piston in each axial direction. The lower rod 32 has a nail-driving end 50 at the lower end thereof and a piston 52 at the upper end thereof. The lower end of the lower rod 32 rides in the nail-receiving bore 16 so that the nail-driving end 50 can impinge on heads of nails for driving the nails. The piston 52 rides in the lower end of the cylinder 44 and is prevented from moving downwardly by an end wall 54 of the cylinder 44. It should be noted that the pistons 42 and 52 allow the driving rod 12 to be compressed from either end of the cylinder 44, although it is not known if this is critical to proper operation of the device.

With regard to the yieldable force-transmitting member 34, in addition to the cylinder 44, it comprises series-mounted belleville spring washers 56, positioned between the upper and lower pistons 42 and 52. In the preferred embodiment, these belleville spring washers are sold under catalog number B1000–073 by SPEC Associated Spring Barnes Group, Inc. These washers have a thickness of 1.85 mm, a height of 2.31 mm and have a calculated load at flat position of 1,335 pounds. There are 27 washers mounted in series (each washer being mounted in an orientation rotated 180° from the two adjacent washers), however, as few as 26 washers and as many as 28 washers will work. In the preferred embodiment the belleville spring washers are arranged to allow at least 25% of their total compression in response to a load of less than 600 pounds.

Figure 3:
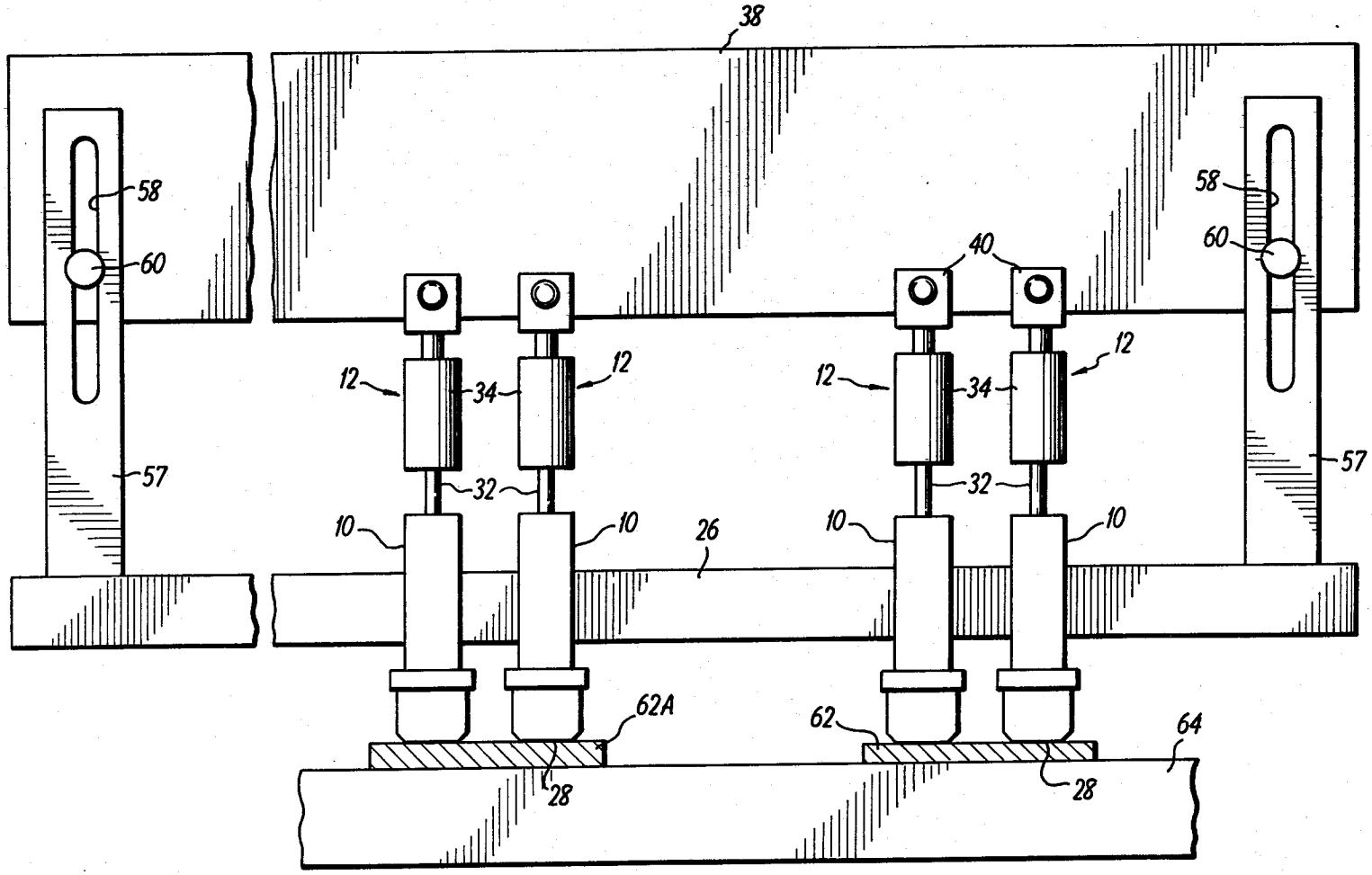
FIG. 3 is an elevational view of a plurality (battery) of nail chucks according to principles of this invention mounted on a driving head and a chuck bar.

The driving head 38 is coupled to the chuck bar 26 by means of vertical supports 57 (FIG. 3) which defines slots 58 in which headed bolts 60 of the driving head 38 ride.

In operation, when the driving head 28 is in a raised position its headed bolts 60 are near the tops of the slots 58 in the vertical supports 57. In this position, lower ends 28 of all nail chucks are raised well above boards 62 and 62A which are to be nailed to another board 64 (the apparatus is not depicted in this stage of a cycle). To begin a nail-driving cycle, the driving head 38 is moved downwardly toward the boards 62, 62A and 64, with the chuck bar 26 and all nail-driving chuck apparatus attached thereto. In this respect, each of the main housings 10 are attached to the chuck bar 26 via the slots 24 and pins 22, with the pins being at the tops of the slots at this point in the cycle.

Once the lower ends 28 of the main housings 10 respectively touch the boards further movement of the driving head 38 applies pressure to the driving rods 12 in a direction to drive nails out of the main housings 10 through the boards. However, some of the boards 62A are wider than average boards 62, thus,lower ends 28 of nail chucks impinging on these boards 62A strike the boards earlier than others. However, the chuck bar 26 is adjusted so that it will cause the lower ends of the main housings 10 to strike the thinnest-possible boards within the acceptable tolerance (in the preferred embodiment, there is a tolerance of $\frac{3}{8}''$ so that the boards could differ by this amount), with the slots 24 being at least as long as the tolerance. Thus, when lower ends 28 of chucks impinge on thicker boards 62A, main housings 10 of these chucks ride upwardly in the slots 24 thus allowing the chuck bar 26 to continue to be moved downwardly until the lower ends of all chucks are brought into contact with their respective boards.

When the driving head 38 is moved downwardly to drive nails, the headed bolts 60 ride in slots 58 of the vertical supports 56. This drives the driving rods 12 through the nail housings 10 to drive nails (not depicted) from the bores 16 out of the main housings 10 through the boards 62 and 62A and into the board 64. As this takes place, the loads on the driving rods 12 increase upwardly to anywhere from 300 to 1,100 pounds, depending on the type of wood into which the nails are driven as well as the sizes and shapes of the nails. During this nail-driving stroke, the yieldable force-transmitting members 34 transmit this driving force, but also for those nails which encounter the most resistance, allows the driving rods 12 to contract. Basically, the belleville spring washers 56 produce a sufficient force for driving the nails, but then allow contraction, upon a development of higher counterforces when the heads of the respective nails strike the upper surfaces of the boards 62, and 62A. The stroke of the driving head 38 is set such that the belleville washer springs reach the necessary driving force to drive nails into the thinnest possible board 62 within board tolerances. When nails have been driven into the thickest board 62A, other driving rods 12, which are driving nails into thinner boards 62, continue to drive. However, this further movement is taken up by the yieldable force-transmitting members 34 for the thicker boards due to an increased counterforce on the driving rods 12 which occurs when the heads of such nails strike the top surfaces of the thicker boards.

It will be appreciated by those skilled in the art that the yieldable force-transmitting members 34 withstand sufficient forces to drive nails, however, thereafter, in response to forces created in the driving rods, when nail heads strike the surfaces of boards into which they are driven, they compress to allow the driving rods 12 to become significantly shorter. This allows associated nail chucks to continue to drive nails.

While the invention has been particularly shown and described with reference to a preferred embodiment, it will be understood by those skilled in the art that various changes in form and detail may be made therein without departing from the spirit and scope of the invention. For example, the yieldable force-transmitting member 34 could be constructed with a mechanism to provide sufficient rigidity to drive a nail, but which yields totally to provide no further driving force at all in response to a predetermined counterforce on the driving rod. Such an arrangement differs from the arrangement described herein in that the belleville-spring-washers described herein continue to exert considerable force on the nail even after they have yielded. In addition, it may be possible to use other types of springs in this invention, however, for such other springs to be practical, they must not have diameters which are substantially larger than the main housing 10 (usually about $1\frac{1}{2}$ inches), because if they do they will prevent adjacent nail chucks from driving nails close together. Further, any spring mechanisms that are used must withstand large numbers of nail-driving cycles such as the belleville washer springs of this invention do.

The embodiments of the invention in which an exclusive property or privilege are claimed are defined as follows:

1. A compensating nail chuck system which compensates for boards of different thicknesses to thereby allow a plurality of nail chucks to simultaneously nail adjacent boards of different thicknesses to a common board, the nailing chuck system comprising:

a plurality of holding means, each for holding a nail in a proper attitude for driving;

a chuck bar having said plurality of holding means mounted thereon said chuck bar including a support means for engaging a driving head and providing relative sliding motion between said chuck bar and said driving head;

mounting means for mounting said plurality of said holding means on said chuck bar but allowing each of said holding means to have independent lost motion relative to said chuck bar, said lost motion for each holding means not occuring until the respective holding means contacts a board to be nailed whereby as each holding means contacts a board, its motion toward the board stops while the chuck bar, and other holding means not yet in contact with boards, continue to move toward boards until all holding means come to rest on their respective boards;

an elongated driving rod for each of said holding means passing through its respective holding means, said rod having a first rod end portion for impinging on a head of said held nail to drive the opposite nail end into a respective board once said holding means is in contact with its respective board and a second rod end portion for receiving a driving force from said driving head, said driving rod including beween said first and second rod end portions a force transmitting member for transmitting driving energy from said driving head to said nail, but for yielding and thereby allowing said driving rod to significantly compress in size in response to a back force created by driving said nail.

2. A compensating nailing chuck system as in claim 1 wherein said force-transmitting member comprises:

a spring member positioned between said first and second rod end portions and a rigid spring guide for supporting said spring member, said spring guide member being slidably connected to the second rod end portion allowing said driving rod to yield at this connection to allow said compression in size of said driving rod.

3. In a nailing chuck system as in claim 1 wherein said force-transmitting member comprises a compressible spring means for developing an expanding force dependent upon its amount of compression.

4. In a nailing chuck system as in claim 3 wherein is further included a rigid spring guide for maintaining said spring means in an orientation for compressing in the direction of an axis of elongation of said driving rod, and wherein said spring means can compress from either of opposite directions relative to said spring guide.

5. In a nail chuck system as in claim 3 or claim 4 wherein said spring means comprises belleville washers arranged in series.

6. A nailing chuck system as in claim 5 wherein said belleville washers are arranged to yield at least 25% of their total compression in response to less than 600 pounds of force.

7. In a nailing chuck system as in claim 5, wherein there are at least 25 belleville washers, but less than 28.

8. In a nailing chuck system as in claim 1 wherein said force-transmitting member must have a breadth of less than one and one-half inches at all longitudinal locations.

* * * * *